United States Patent [19]

Zimmerly

[11] Patent Number: 4,500,014

[45] Date of Patent: Feb. 19, 1985

[54] MULTIPLE FIRING INFLATOR

[75] Inventor: Harry L. Zimmerly, Largo, Fla.

[73] Assignee: Halkey-Roberts Corp., St. Petersburg, Fla.

[21] Appl. No.: 449,677

[22] Filed: Dec. 14, 1982

[51] Int. Cl.[3] ..... B67B 7/24

[52] U.S. Cl. ..... 222/5; 222/6; 222/145; 441/92; 441/93; 441/94; 441/95

[58] Field of Search ..... 222/3, 5, 6, 54, 81, 222/83, 83.5, 129, 145; 441/92-95

[56] References Cited

U.S. PATENT DOCUMENTS 3,308,842 3/1967 Martin ..... 222/5 X 3,579,964 5/1971 Ohlstein ..... 222/5

4,223,805 9/1980 Mackal ..... 441/94 X

*Primary Examiner*—Joseph J. Rolla

*Assistant Examiner*—Kevin P. Shaver

[57] ABSTRACT

Dual firing inflator for an inflatable article. A first gas containing capsule is pierced by energy supplied either manually or by a compressed spring of the like and the gas from the pierced first capsule powers a second piercing pin which pierces a second gas containing capsule. This reduces the amount of externally applied energy which is necessary to operate the inflator while supplying the inflatable article with an amount of gas which is twice that contained in capsules which are normally used with inflators of the same general type.

7 Claims, 3 Drawing Figures

MULTIPLE FIRING INFLATOR

This invention relates to an inflator for inflatable articles such as life vests and the like. More particularly, the invention relates to a means of piercing two or more gas-filled cylinders utilizing the external energy required to pierce only one cylinder. The energy required to pierce the additional cylinder or cylinders is derived from the first cylinder.

Life jackets and other inflatable devices utilize inflators to pierce the frangible cap or seal on gas cylinders, which generally contain $CO_2$. The energy required to pierce the gas cylinder usually comes from one of two sources: human energy, or energy stored in a spring.

There are times, however, when it is desirable to use more than one gas cylinder on an inflatable device. One such instance is that when a life jacket requires 35 lbs. of buoyancy and it requires about 32 grams of $CO_2$ to inflate the device. One 32 gram $CO_2$ cylinder is expensive, and not readily available. Two 16 gram $CO_2$ cylinders, however, are less expensive than one 32 gram cylinder, and 16 gram cylinders are readily available. Furthermore, two 16 gram cylinders present a flatter and shorter profile than one 32 gram cylinder. A configuration employing two 16 gram cylinders produces a flatter and, therefore, a more esthetically pleasing shape to any life jacket on which the inflator may be placed.

Double inflators have, in the past, been used primarily on military life jackets. The mechanism that was used to pierce both cylinders was a completely manual one, requiring the operator to provide enough energy to pierce both cylinders. This manual system did not readily lend itself to stored-energy piercing systems, such as that disclosed in Mackal U.S. Pat. No. 4,223,805. Stored energy systems would have to store twice as much energy to pierce the two gas cylinders (e.g. require a spring twice as large).

The inflator of the present invention, however, requires that the spring or other stored energy means need have only enough power or energy to pierce one gas cylinder. The additional energy required to pierce the additional cylinder or cylinders is derived from the energy stored in the one or more gas cylinders themselves.

The invention will be more readily understood upon consideration of the accompanying drawings, in which.

Figure 1:
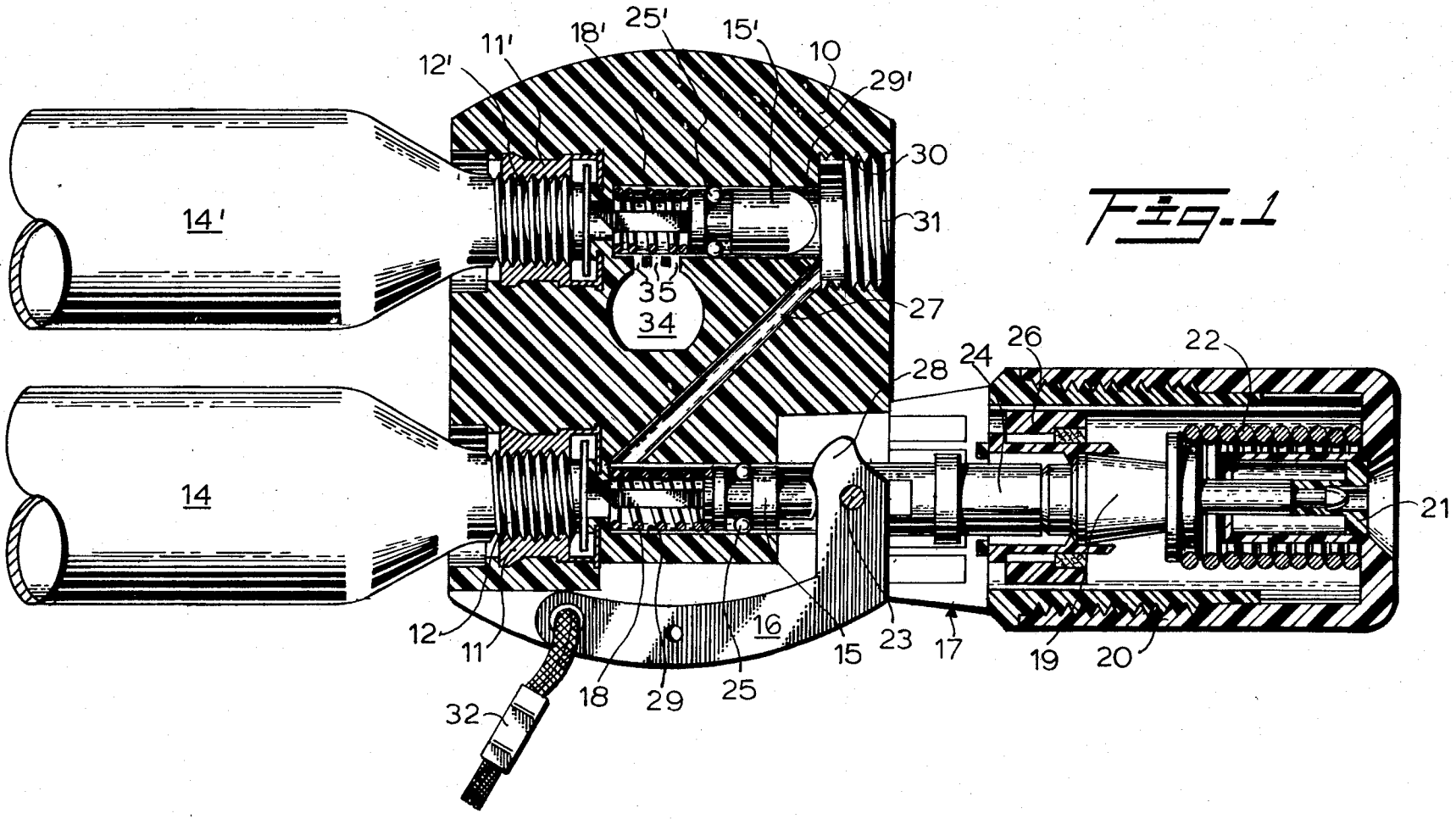
FIG. 1 is a view partially in axial cross-section and partially in side elevation of a preferred embodiment of inflator in accordance with the invention, the figure being shortened by breaking through the gas cylinders, the inflator being selectively operable manually or automatically, the portion of the apparatus which is capable of automatic operation being shown in its ready-cocked condition.
Figure 2:
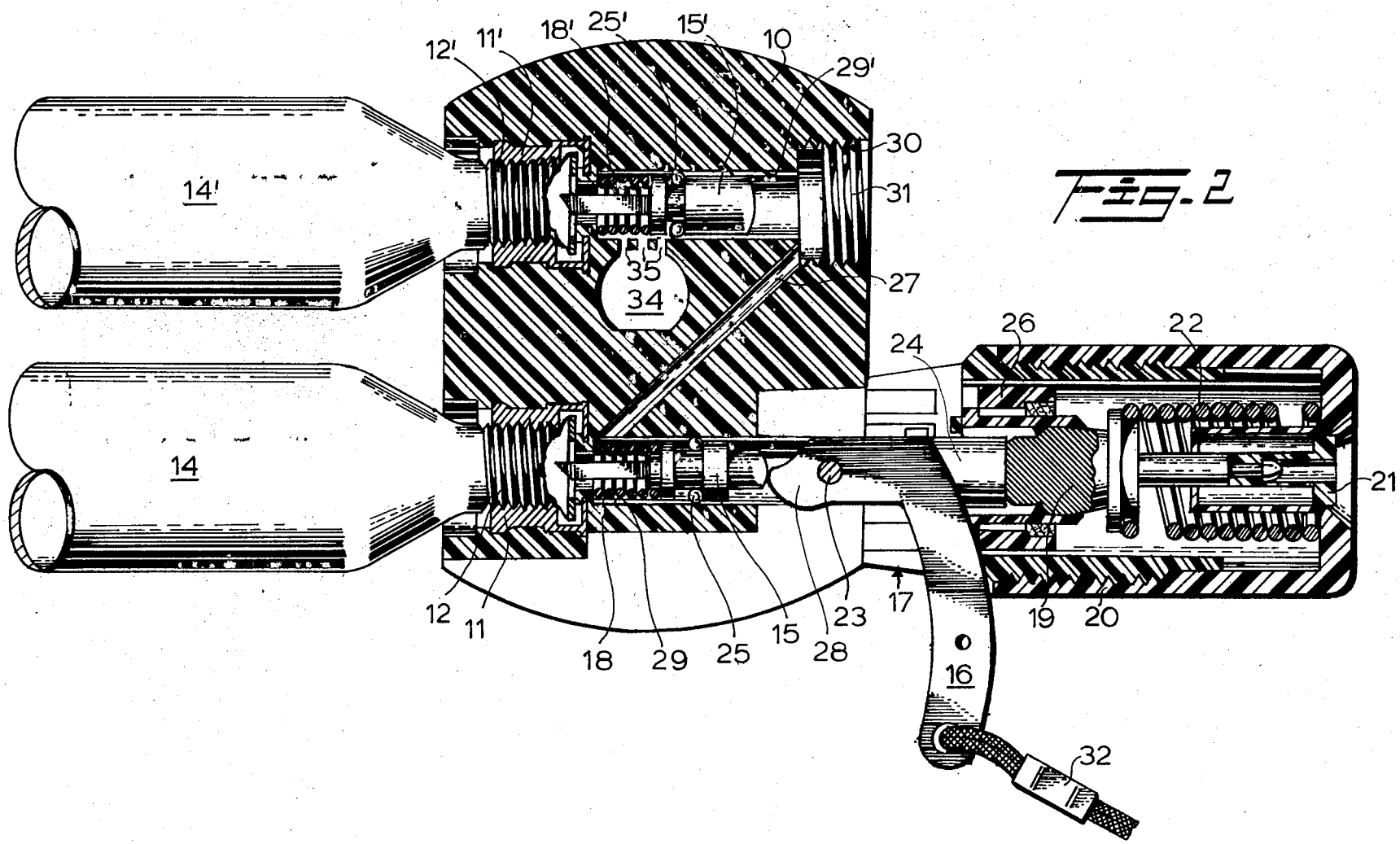
FIG. 2 is a fragmentary view of the inflator shown in FIG. 1 with the inflator having been operated manually.
Figure 3:
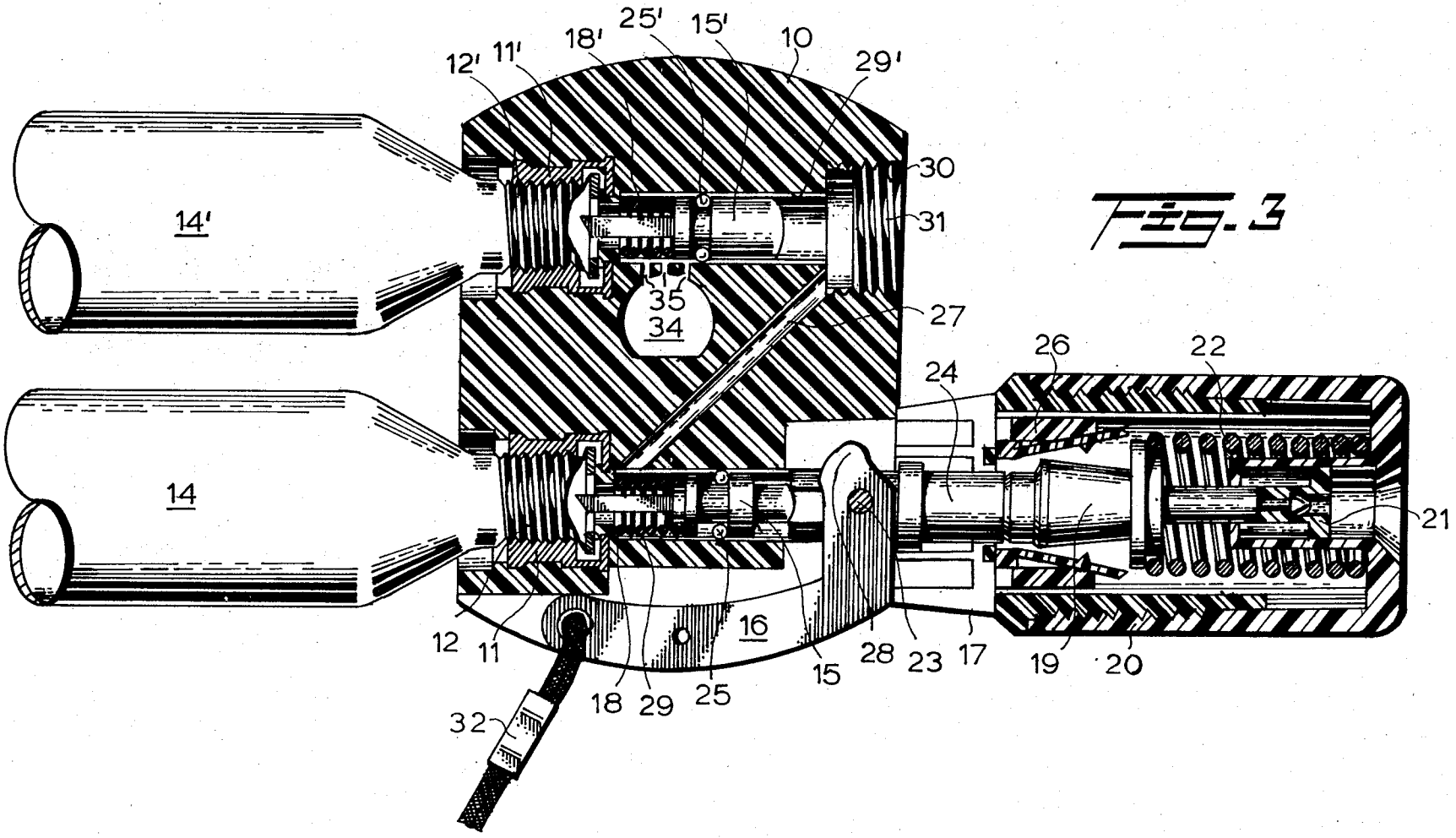
FIG. 3 is a view of the inflator similar to that of FIG. 1 but with the inflator having been operated automatically.

The portion of the inflator of the invention which is shown in the lower half of each of FIGS. 1, 2 and 3 is generally similar to that illustrated and described in Mackal U.S. Pat. No. 4,223,805 except, of course, for the fact that in such patent there is shown an inflator employing a single compressed gas containing capsule. The body 10 of the inflator of the present invention, which may be made, for example, of glass-filled polyester, has an internally threaded metal insert 11 which receives the threaded neck 12 of a compressed $CO_2$ containing capsule 14. This capsule is hereinafter designated the "primary capsule". In the lower portion of body 10 as shown there is provided a primary piercing pin 15 which reciprocates in a bore 29 between the retracted position thereof shown in FIG. 1 and the advanced position thereof shown in each of FIGS. 2 and 3. An O-Ring 25 on the piercing pin 15 provides a seal between such pin and the wall of bore 29. The piercing pin 15 is normally held in its retracted position by a light coil compression spring 18. A manually operated firing lever 16 is pivotally mounted upon body 10 by a pivot pin 23. A cam 28, integral with lever 16, thrusts the piercing pin 15 to the left so as to puncture a frangible seal on the neck 12 of capsule 14 when the lever 16 is swung counter-clockwise from the position thereof shown in FIG. 1. Such swinging of the lever is accomplished by the pulling of a lanyard 32 which is attached to the outer end of the long arm of the lever 16.

In accordance with the construction shown and described in the above-cited Mackal U.S. Pat. No. 4,223,805, the automatic firing portion of the inflator is made as an attachment to the body 10, the attachment being secured to the body 10 by the pivot pin 23 which passes through laterally spaced ears on the attachment, such ears straddling the body 10. The automatic firing portion of the apparatus has a housing 17 upon which there is mounted a threaded cap 20. The housing has a striker pin 19 mounted coaxially thereof, such striker pin being urged to the right by a large coil compression spring 22. A striker pin retainer 21 is provided on the outer end of the cap 20. The striker pin 19, when the automatic inflator portion of the apparatus is activated, forcibly thrusts a cross-slotted impact transfer fork 24 to the left whereby to thrust the piercing pin 15 to the left and thus to cause such piercing pin to pierce the frangible seal on the neck 12 of the capsule 14. The striker pin 19 is held in its ready-cocked condition shown in FIG. 1 by an automatic firing trigger bobbin 26 which is of the same construction and which operates in the same manner as the member 65 shown in FIGS. 8–11, incl., of Mackal U.S. Pat. No. 4,223,805. It is to be understood that the bobbin 26 is provided with a water-destructible annular ring which disintegrates when it is contacted by water entering the housing 17, thereby to permit the striker pin 19 to travel forcibly to the left and thus to thrust the impact transfer fork 24 and the primary piercing pin 15 to the left as above described.

The body 10 of the inflator is somewhat wider than that of the above-cited Mackal patent, in order to accomodate a secondary $CO_2$ containing capsule 14'. The neck 12' of such secondary capsule is likewise screwed into the body 10, in the illustrative embodiment into a metal insert 11' provided in the upper part of the body 10 as shown in the drawings. The upper part of body 10 is provided with a bore 29' in which there is reciprocably mounted a second piercing pin 15', piercing pin 15' being likewise constantly urged toward the right by a light coil compression spring 18'.

An inclined passage 27 extends from the forward end of the bore 29, which contains the primary piercing pin 15 to the rear end of the bore 29' containing the secondary piercing pin 15'. To permit the passage 27 to be drilled into the body 10, there is provided an internally threaded bore 30 coaxial of bore 29' in body 10, the threaded bore 30 being closed by a plug 31. It is to be noted that, in the illustrative embodiment, the secondary piercing pin 15' differs from the primary piercing pin 15 in that its rear or righthand end is in the form of a piston rather than in the form of a cam follower, as is the case with the piercing pin 15. However, if desired, the two piercing pins can be of the same shape, that is, the shape of pin 15 or the shape of pin 15'. It is also to be noted that, in the embodiment shown, the inner or lefthand end of the plug 31, which forms a stop for the secondary piercing pin 15' in its retracted position, is cross-slotted to permit ready access of gas discharged from the capsule 14 after the seal on such capsule has been pierced by the primary piercing pin 15 to impinge upon the righthand end of the piston portion of the secondary piercing pin 15' after such gas has travelled through the passage 27. The same effect can be secured by using a shorter plug 31 which does not bottom on the threads in body 10 and does not interfer with the passage 27. The gas thus delivered to the rear or righthand end of the piston-forming portion of the secondary piercing pin 15' thrusts such pin to the left so that the secondary piercing pin pierces the sealing means on the neck 12' of the capsule 14' after the secondary piercing pin has been advanced toward the left. In its advanced position, the piercing pin 15' carries with it its O-ring sealing means 25' for a sufficient distance to uncover at least a portion of the passage between the D-shaped hole 34 and the bore 29' in which the secondary piercing pin is mounted. It will be seen that in the illustrated embodiment such passage is composed of a plurality (three shown) of small holes 35. Such construction in effect provides a bridge over which the O-ring 25' can travel without damage, while at the same time providing a passage of sufficient cross-section to allow the gas to flow therethrough from both capsules 14 and 14' without any undue throttling of such flow. It will be seen that gas released from the primary capsule 14, after having travelled through the passage 27 and having thrust the secondary piercing pin 15' to the left sufficiently for the sealing means 25' to have travelled to the left of at least a portion of the passage made up of holes 35 between bore 29' and passage 34 then travels past the piston-forming portion of the secondary piercing pin, which loosely fits within the bore 29', through the passage 35 into the D-shaped hole 34. The D-shaped hole 34 receives a stem of complementary cross-section which is connected to the inflatable article as shown in the above-cited Mackal patent.

At the same time that the gas released from capsule 14 travels into the stem contained in hole 34, gas which has now been released from the secondary capsule 14' by the piercing of its seal by the secondary piercing pin travels through the hole thus punctured in its seal past the lefthand end portion of the piercing pin 15' and into hole 34 through the passage made up of holes 35. The passage of gas from the secondary capsule 14' into the hole 34, even though the secondary piercing pin 15' remains thrust to the left by gas from the primary capsule 14 acting upon its righthand end, is facilitated if the lefthand active end portion of the secondary piercing pin is fluted in cross-section or is in the form of a split pin as shown and described in Mackal patent application Ser. No. 377,165 filed May 11, 1982, now abandoned.

Once the primary capsule 14 has been pierced, gas travels through the gas passage 27 to the righthand end of the secondary piercing pin 15'. This gas is at high pressure (850 psi for $CO_2$, greater for air or other compressed gases), and forces the secondary piercing pin 15' to the left, piercing the secondary capsule 14'. Varying gas pressures will then move the secondary piercing pin 15' to a position where gas from both cylinders can vent through the passage composed of holes 35 into the inflatable device through the D-shaped hole 34. It is advisable that the dimensions of the parts be such that the O-ring seal 25' of the secondary piercing pin not pass the threshold of the opening composed of holes 35 into the D-shaped hole 34 until the piercing tip of the secondary piercing pin 15' has satisfactorily pierced the secondary capsule 14'.

Although the invention is described and illustrated with reference to a single preferred embodiment thereof, it is to be expressly understood that it is in no way limited to the disclosure of such preferred embodiment but is capable of numerous modifications within the scope of the appended claims.

I claim:

1. In an inflator adapted for use with gas-inflatable articles, said inflator having a body with means to discharge gas therefrom, means for holding a first gas capsule on the body, a first pin for piercing the first capsule, and means for advancing the first piercing pin and the first capsule relatively toward each other to pierce the first capsule, the improvement which comprises means on the body for holding a second gas capsule, a second pin for piercing the second capsule, and means including a cylinder having a piston therein for advancing the second piercing pin and the second capsule relatively toward each other to pierce the second capsule, first conduit means in the body for leading gas discharged from the first capsule to the cylinder to drive the piston therein in a second capsule piercing stroke, means in the body for combining the flows of gas from the first and second capsules, and second conduit means in the body for leading the combined gas flow from the first and second capsules to the gas discharge means on the body.

2. The inflator set forth in claim 1, wherein the piston loosely fits in the cylinder whereby there is formed a space between the piston and the side wall of the cylinder so that gas from the first capsule can flow through the space between the piston and the side wall of the cylinder, and the space between the piston and the cylinder constitutes a part of the second conduit means.

3. The inflator set forth in claim 1, wherein the first and second gas capsules are elongated and are held in spaced parallel, similarly oriented, relationship on the body, the piercing of the first capsule taking place adjacent a first end of the body, the first and second piercing pins are disposed in parallel, similarly oriented, relationship, and the first conduit means extends angularly with respect to the longitudinal axes of the capsules and the piercing pins from the location of the piercing of the first capsule adjacent the first end of the body to the end of the cylinder adjacent the second end of the body of the inflator.

4. The inflator according to claim 1, wherein the means for advancing the first piercing pin and the first capsule relatively toward each other to pierce the first capsule comprises a manually operated cam thereon for selectively thrusting the first piercing pin in a first capsule piercing direction.

5. The inflator according to claim 1, wherein the inflator operates automatically when immersed in water, and comprising resilient means constantly urging the first piercing pin and the first capsule toward each other, and a latching means for holding the piercing pin and the capsule in spaced-apart cocked position, said latching means including a water-destructible member which when destroyed releases the latching means so that the first piercing pin pierces the first capsule.

6. The inflator set forth in claim 1, comprising means on the body for fixedly positioning the first and second capsules thereon, and wherein the first and second piercing pins are mounted for reciprocation in the body, the cylinder is located in the body, and the piston is mounted relative to the second piercing pin so as to thrust it toward the second capsule to pierce it.

7. The inflator set forth in claim 6, wherein the second piercing pin is disposed coaxially of the piston and extends forwardly therefrom toward the second gas capsule, the means to discharge gas from the inflator body communicates with the forward portion of the cylinder through a gas conducting passage through the wall of the cylinder, and comprising resilient means for constantly thrusting the second piercing pin and the piston rearwardly away from the second gas capsule, and sealing means interposed between the piston and the cylinder wall, such sealing means being disposed rearwardly of the gas-conducting passage through the cylinder wall when the piston is in its rearward position whereby then to seal the rear end of the cylinder from communication with the passage through the wall of the cylinder, the sealing means traveling with the piston when the latter is urged in a forward stroke so that the sealing means then moves forwardly of a threshold position with respect ot the gas-conducting passage through the cylinder wall whereby to establish communication between the first and second conduit means.

* * * * *